US010364124B2

(12) United States Patent
Sherril

(10) Patent No.: US 10,364,124 B2
(45) Date of Patent: Jul. 30, 2019

(54) ROPE DISPENSING DEVICE

(71) Applicant: TOBE'S LLC, Greensboro, NC (US)

(72) Inventor: William Tobias Sherril, Greensboro, NC (US)

(73) Assignee: TOBE'S LLC, Greensboro, NC (US)

( * ) Notice: Subject to any disclaimer, the term of this patent is extended or adjusted under 35 U.S.C. 154(b) by 31 days.

(21) Appl. No.: 15/604,148

(22) Filed: May 24, 2017

(65) Prior Publication Data

US 2017/0341900 A1 Nov. 30, 2017

Related U.S. Application Data

(60) Provisional application No. 62/340,787, filed on May 24, 2016.

(51) Int. Cl.

| | |
|---|---|
| ***B65H 51/10*** | (2006.01) |
| ***B65H 51/32*** | (2006.01) |
| ***B65H 57/04*** | (2006.01) |

(52) U.S. Cl.

CPC ..... *B65H 51/10* (2013.01); *B65H 51/32* (2013.01); *B65H 57/04* (2013.01); *B65H 2404/11* (2013.01); *B65H 2404/144* (2013.01); *B65H 2701/35* (2013.01)

(58) Field of Classification Search

CPC ..... B65H 51/02; B65H 51/10; B65H 51/32; B65H 2402/41; B65H 2402/412; B65H 2402/414; B65H 2701/35

See application file for complete search history.

(56) References Cited

U.S. PATENT DOCUMENTS

| | | | |
|---|---|---|---|
| 1,186,909 | A | 6/1916 | Huttlemaier |
| 1,820,094 | A | 8/1931 | Smith et al. |
| 2,639,097 | A | 5/1953 | Scott, Jr. |
| 2,662,703 | A | 12/1953 | Brown |
| 4,026,483 | A | 5/1977 | Skalleberg |
| 4,132,367 | A | 1/1979 | Ineson et al. |
| 4,165,830 | A | 8/1979 | Svendsen |

(Continued)

FOREIGN PATENT DOCUMENTS

| | | |
|---|---|---|
| WO | 1982003214 | 9/1982 |
| WO | 1999054248 | 10/1999 |
| WO | 2004035455 A2 | 4/2004 |

*Primary Examiner* — Michael C McCullough

(74) *Attorney, Agent, or Firm* — Moore & Van Allen PLLC; Nicholas C. Russell

(57) ABSTRACT

Aspects of the present invention relate to a rope dispensing device for delivering elongated material such as rope, wire, or hosing and generally has a mounting frame operatively coupled to a material feeding device comprising a wheel and pinch device, an adjustable shroud, and a stabilizing device. The elongated material is received into the material feeding device from a first location and driven through the rope dispensing device by the wheel to be output at a second location. The adjustable shroud may be positioned about the periphery of the wheel so as to direct the output elongated material from the rope dispensing device. The invention is at least partially supported by the stabilizing device operatively coupled to a body of a user. Additionally, the stabilizing device is extendable, collapsible, and detachable allowing the invention to take on a more compact form for easier storage and/or transportation.

20 Claims, 11 Drawing Sheets

(56) References Cited

U.S. PATENT DOCUMENTS

| | | | | |
|---|---|---|---|---|
| 4,383,516 | A * | 5/1983 | La See | F41B 5/1488 124/80 |
| 4,577,810 | A | 3/1986 | Sandvik | |
| 4,605,456 | A | 8/1986 | Annis, Jr. | |
| 4,609,160 | A | 9/1986 | Linderoth et al. | |
| 4,756,788 | A | 7/1988 | Bedell et al. | |
| 5,566,901 | A | 10/1996 | Wilder | |
| 5,626,307 | A | 5/1997 | Smith | |
| 6,796,522 | B2 * | 9/2004 | Braun | A62B 1/06 226/177 |
| 7,971,819 | B2 | 7/2011 | Marangoni | |
| 9,043,999 | B1 | 6/2015 | Boester | |
| 2008/0061184 | A1 | 3/2008 | Simbirski et al. | |
| 2008/0164364 | A1 | 7/2008 | Kaltman | |
| 2010/0181410 | A1 | 7/2010 | Ting et al. | |

* cited by examiner

ROPE DISPENSING DEVICE

RELATED APPLICATIONS AND PRIORITY CLAIM 35 U.S.C. § 119

This application is a non-provisional filing of U.S. Provisional Application No. 62/340,787, filed May 24, 2016, the contents of which are hereby incorporated by reference herein.

BACKGROUND

Elongated material such as rope, wire, cords, or hosing is typically used around construction sites, boats, households, and many other applications. In some cases, the task of collecting or dispensing the elongated material by hand can become time-consuming with long lengths of the elongated material. While there exist devices to collect and spool elongated material, these devices tend to not be easily transported or are fixed to a specific object or location limiting the application and use. As such, there exists a need for a portable, collapsible device which is able to quickly and efficiently deliver elongated material, such as rope, for collection or use.

BRIEF SUMMARY

The following presents a simplified summary of several embodiments of the invention relating to a handheld, portable device for delivering elongated material. In some embodiments, the rope dispensing device comprises a wheel approximately 12 inches in diameter with an opposing pinch device. The wheel is spun by hand or motor to grab and deliver rope cordage into a bag or onto a tarp.

Initially, an end of rope is fed by a user through a guide which directs the rope into a material feeding device composed of a wheel and pinch device. Alternatively, the rope may be threaded through the top of the guide so as to allow rope to be added laterally mid-length into the material feeding device. The user employs a handle attached to the outer face of the wheel to drive the wheel in the user-desired direction of the rope output. Passing through the material feeding device, the rope is driven by the wheel, grabbed from a first side by the pinch device, passed between the wheel and the pinch device, and output onto a second side of the material feeding device. The output rope passes under an adjustable shroud which directs the output rope depending on the desire of the user. The output rope may be directed, for example, into a receptacle for collection such as a bag, tarp, or other container.

More specifically, the claimed invention as described herein relates to a handheld, portable rope dispensing device for collecting and delivering elongated material such as rope, hosing, cords, wire, or the like. The device comprising a mounting frame which acts as a base for the device, wherein any additional components and devices of the rope dispensing device are operatively coupled thereto. Components operatively coupled to the mounting frame of the rope dispensing device, in one embodiment of the invention or another, include an adjustable shroud, a material feeding device, and a stabilizing device. The mounting frame itself has a first and second side, wherein the first side is open or generally open exposing the wheel, while the second side allows for the attachment of the additional components.

The adjustable shroud is configured for directing the elongated material to a second location after the elongated material is initially displaced from a first location and processed through the rope dispensing device.

The main purpose of the stabilizing device is to support the rope dispensing device by positioning or resting the stabilizing device to the body of the user. While designed to be operated in an extended configuration, the stabilizing device is also able to slide along a rail on the mounting frame in order to collapse into the mounting frame to create a more compact form for convenient storage and/or transportation of the device. In some embodiments, the stabilizing device is able to be detached from the mounting frame of the rope dispensing device leading not only to an even more compact form for storage and/or transportation, but also allowing for reattachment of the stabilizing device at an alternate location on the mounting frame which provides an additional operating configuration for the device, wherein the elongated material may be delivered to the front of the user or behind the user depending on the configuration.

The material feeding device grabs and uptakes the elongated material as the elongated material is processed through the rope dispensing device. The material feeding device generally comprises a pinch device and a wheel which act in conjunction to drive the elongated material from a first side of the material feeding device to a second side. In some embodiments of the invention, the wheel is driven manually by the user. In some embodiments, the wheel is driven by a motor. In some embodiments, the pinch device may be a spring-loaded pinch wheel which is in contact with the wheel and allows for the input of variable sizes of elongated material into the material feeding device. In other embodiments, the pinch device is any mechanism capable of applying pressure to the elongated material in order to feed the elongated material using the wheel.

The invention may be exampled by a device for delivering elongated material which defines a specific embodiment of the invention, the device comprising: a mounting frame comprising a first side and a second side; a wheel rotationally coupled to the mounting frame; a material feeding device operatively coupled to the mounting frame; an adjustable shroud operatively coupled to the mounting frame; and a stabilizing device operatively coupled to the mounting frame, wherein the material feeding device receives the elongated material at a first location and outputs the elongated material at a second location, wherein the adjustable shroud is configured for directing the elongated material to the second location, and wherein the stabilizing device is operatively coupled to a body of a user to support the portable device.

In some embodiments, the first side of the mounting frame further comprises: the material feeding device adjacent to an outer portion of the wheel; the adjustable shroud extendably and detachably coupled to the first side of the mounting frame; and the stabilizing device spanning a portion of an aperture created by the wheel outside of the width of the wheel, and wherein the second side of the mounting frame is rotationally coupled to the wheel.

In some embodiments, the wheel is circular and further comprises: a first side rotationally coupled to the mounting frame; a second side comprising a handle; an outer portion comprising a tire operatively coupled to the wheel; and an inner portion concentric and parallel to the outer portion, wherein the diameter of the inner portion is less than the diameter of the outer portion and wherein the wheel creates an aperture within a width of the wheel.

In some embodiments, the first side of the wheel is rotationally coupled to the second side of the mounting frame with one or more bearings.

In some embodiments, the adjustable shroud positioned adjacent to at least a portion of the outer portion of the wheel and controls a change in direction of the elongated material based on the position of the shroud in relationship to the outer portion of the wheel and the material feeding device.

In some embodiments, the stabilizing device forms around at least a portion of the outer portion of the wheel and comprises a first plate and a second pate, wherein the stabilizing device is extendable, collapsible, and detachable from the mounting frame, and wherein the first plate and the second plate of the stabilizing device comprise one or more members that interact with a user.

In some embodiments, the material feeding device further comprises: a pinch device operatively coupled to an engagement handle; and a guide positioned adjacent to the pinch device, wherein the engagement handle is operatively coupled to a first spring; wherein a force applied to the engagement handle decreases a distance between the pinch device and the wheel; and wherein the pinch device and the wheel receive the elongated material input from the guide within the distance between the pinch device and the wheel and output the elongated material to the adjustable shroud.

In some embodiments, the pinch device further comprises a pinch wheel operatively coupled to a second spring and in contact with the wheel to accept various sizes of elongated material between the wheel and the pinch device.

In some embodiments, the elongated material comprises rope, wire, or hosing and wherein when the elongated material fed through the device generally forms a spool of elongated material.

In some embodiments, the wheel is driven manually by a user, while in other embodiments, the wheel is driven by a motor.

The invention may also be exampled by a device for delivering elongated material which defines another specific embodiment of the invention, the device comprising: a mounting frame comprising a first side and a second side; a material feeding device operatively coupled to the mounting frame; an adjustable shroud operatively coupled to the mounting frame; a stabilizing device operatively coupled to the mounting frame; and a wheel comprising a first side rotationally coupled to the mounting frame, a second side, an outer portion operatively coupled to the wheel, and an inner portion concentric and parallel to the outer portion, wherein the diameter of the inner portion is less than the diameter of the outer portion, wherein the wheel creates an aperture within a width of the wheel, wherein the material feeding device receives the elongated material at a first location and outputs the elongated material at a second location, wherein the adjustable shroud is configured for directing the elongated material to the second location, and wherein the stabilizing device is operatively coupled to a body of a user to support the portable device.

The invention may also be further exampled by a device for delivering elongated material which defines another specific embodiment of the invention, the device comprising: a mounting frame comprising a first side, a second side, and an axle; a wheel rotationally coupled to the axle; a material feeding device operatively coupled to the mounting frame; an adjustable shroud operatively coupled to the mounting frame; and a stabilizing device operatively coupled to the mounting frame, wherein the material feeding device receives the elongated material at a first location and outputs the elongated material at a second location, wherein the adjustable shroud is configured for directing the elongated material to the second location, and wherein the stabilizing device is operatively coupled to a body of a user to support the portable device.

The features, functions, and advantages that have been discussed may be achieved independently in various embodiments of the present invention or may be combined with yet other embodiments, further details of which can be seen with reference to the following description and drawings.

BRIEF DESCRIPTION OF DRAWINGS

The foregoing and other advantages and features of the invention, and the manner in which the same are accomplished, will become more readily apparent upon consideration of the following detailed description of the invention taken in conjunction with the accompanying drawings, which illustrate embodiments of the invention and which are not necessarily drawn to scale, wherein.

DETAILED DESCRIPTION

Embodiments of the present invention now may be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

As used herein the term "elongated material" or "rope" means material that is longer than it is wide. Examples of elongated material that are especially applicable to the present invention include rope, hosing, cords, and wire. In some embodiments, elongated material may have a rounded cross-sectional shape. In other embodiments, elongated material may be flat, wherein the cross-section is relatively negligible such as a strap of material.

It should be understood that "operatively coupled," when used herein, means that the components may be formed integrally with each other, or may be formed separately and coupled together. Furthermore, "operatively coupled" means that the components may be formed directly to each other, or to each other with one or more components located between the components that are operatively coupled together. Furthermore, "operatively coupled" may mean that the components are detachable from each other, or that they are permanently coupled together. Furthermore, operatively coupled components may retain at least some freedom of movement in one or more directions or rotated about an axis (i.e., rotationally coupled)

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more."

Figure 1:
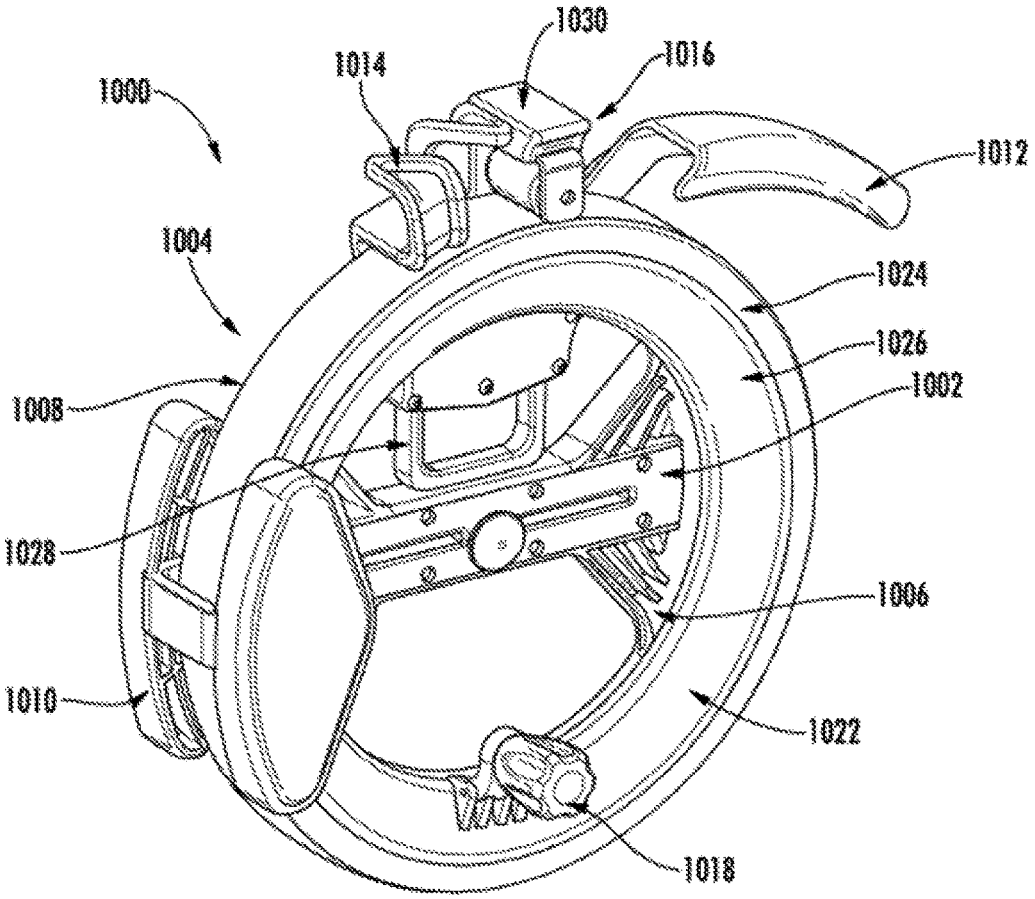
FIG. 1 illustrates a perspective view of a hubless rope dispensing device, in accordance with one embodiment of the invention.

FIG. 1 illustrates a perspective view of a hubless rope dispensing device, in accordance with one embodiment to the invention 1000. As seen in FIG. 1, the hubless rope dispensing device 1000 may comprise a mounting frame 1002 which may further comprise a first side 1004 (visible in FIG. 2) and a second side 1006. The mounting frame 1002 may be a circular body with a diameter that is less than or equal to the diameter of a wheel 1008. In some embodiments the diameter of the mounting frame 1002 may be greater than the diameter of the wheel 1008. The mounting frame 1002 may further comprise a first side 1004 and a second side 1006. In some embodiments, the first side 1004 and/or second side 1006 may have at least a partially circular shape. The mounting frame 1002 may be composed of metal, plastic, and/or a composite material. The mounting frame 1002 has mounting portions for affixing components to the mounting frame 1002. Components operatively coupled to the mounting frame 1002 may include a stabilizing device 1010, an adjustable shroud 1012, a guide 1014, a material feeding device 1016, a pinch device 1030, an engagement handle 1028, a handle 1018, and/or other components described herein. The components may be operatively coupled to either the first side 1004 or the second side 1006 of the mounting frame 1002 via one or more mounting portions.

The hubless rope dispensing device 1000 may comprise a wheel 1008. In some embodiments, the wheel 1008 may be a hubless or "center-less" wheel that is not operatively coupled to a central axle similar to a traditional wheel. In some embodiments, the wheel 1008 may be operatively coupled or rotationally coupled to one or more ball bearings, roller bearings, and/or the like which, in turn, may be operatively coupled or rotationally coupled to at least a portion of mounting frame 1002 of the rope dispensing device 1000.

In some embodiments, the wheel 1008 may be a circular body that further comprises a first side 1020 (not shown) and a second side 1022. In some embodiments, the first side 1020 of the wheel 1008 may be operatively and/or rotationally coupled to the second side 1006 of the mounting frame 1002. The wheel 1008 may be rotationally coupled to the second side 1006 of the mounting frame 1002 with one or more ball bearings, roller bearings, and/or the like. In this way, both the first side 1004 and the second side 1006 of the mounting frame 1002 may be held stationary during operation (e.g., by the user or another static body) while the wheel 1008 is allowed to rotate relative to the mounting frame 1002. In some embodiments, the second side 1022 of the wheel 1008 may further comprise a handle 1018, wherein the handle 1018 is operatively coupled to the second side 1022 of the wheel 1018. During operation of the device, the wheel 1008 is rotated in a circular motion relative to the mounting frame 1002 using the one or more bearings and/or the like used to rotationally couple the first side 1020 of the wheel 1008 to the second side 1006 of the mounting frame 1002. In some embodiments, the handle 1018 may be rotationally coupled to the second side 1022 of the wheel 1008 to allow the user to apply a force to the handle 1018 in order to manually drive and propel the wheel 1008.

The wheel 1018 may further comprise an outer portion 1024 and an inner portion 1026, wherein the perimeters of the outer portion 1024 and the inner portion 1026 are substantially parallel to one another, and/or wherein the outer portion 1024 and the inner portion 1026 are concentric circular bodies, wherein a diameter of the inner portion 1026 is less than a diameter of the outer portion 1024. In some embodiments, the outer portion 1024 of the wheel 1018 may comprise a tire composed of rubber, urethane, plastic, polymer, and/or the like operatively coupled to the wheel 1008. In some embodiments, the outer portion 1024 of the wheel may come into contact with a material feeding device 1016. The inner portion 1026 of the wheel 1018 may further comprise an inner area or aperture that is at least partially hollow, wherein he inner area or aperture created by the wheel 1008 is within the width of the wheel. The inner area or aperture may be defined by an inner diameter that is less than a diameter of the inner portion 1026 of the wheel 1008. In some embodiments, the inner area of the inner portion 1026 is hollow so that the wheel 1008 may have a circular hole or void that is concentric with the wheel 1008. In some embodiments, at least a portion of the mounting frame 1002 or other components of the rope dispensing device 1000 may be located inside the inner area of the inner portion 1026 of the wheel 1008. In some embodiments, the inner area of the inner portion 1026 of the wheel 1008 remains substantially empty during operation of the hubless rope dispensing device 1000. The hollow inner area is designed allow the mounting frame 1002 to be lightweight while still providing sufficient structure and support to the rope dispensing device 1000.

In other embodiments, the wheel 1008 may be rotationally coupled to the outer periphery of the mounting frame 1002, wherein the wheel 1008 may be rotationally coupled to the circumference of the mounting frame 1002 with one or more ball bearings, roller bearings, and/or the like. In this way, the wheel 1008 may be allowed to rotate relative to the periphery circumference of mounting frame 1002.

Figure 2:
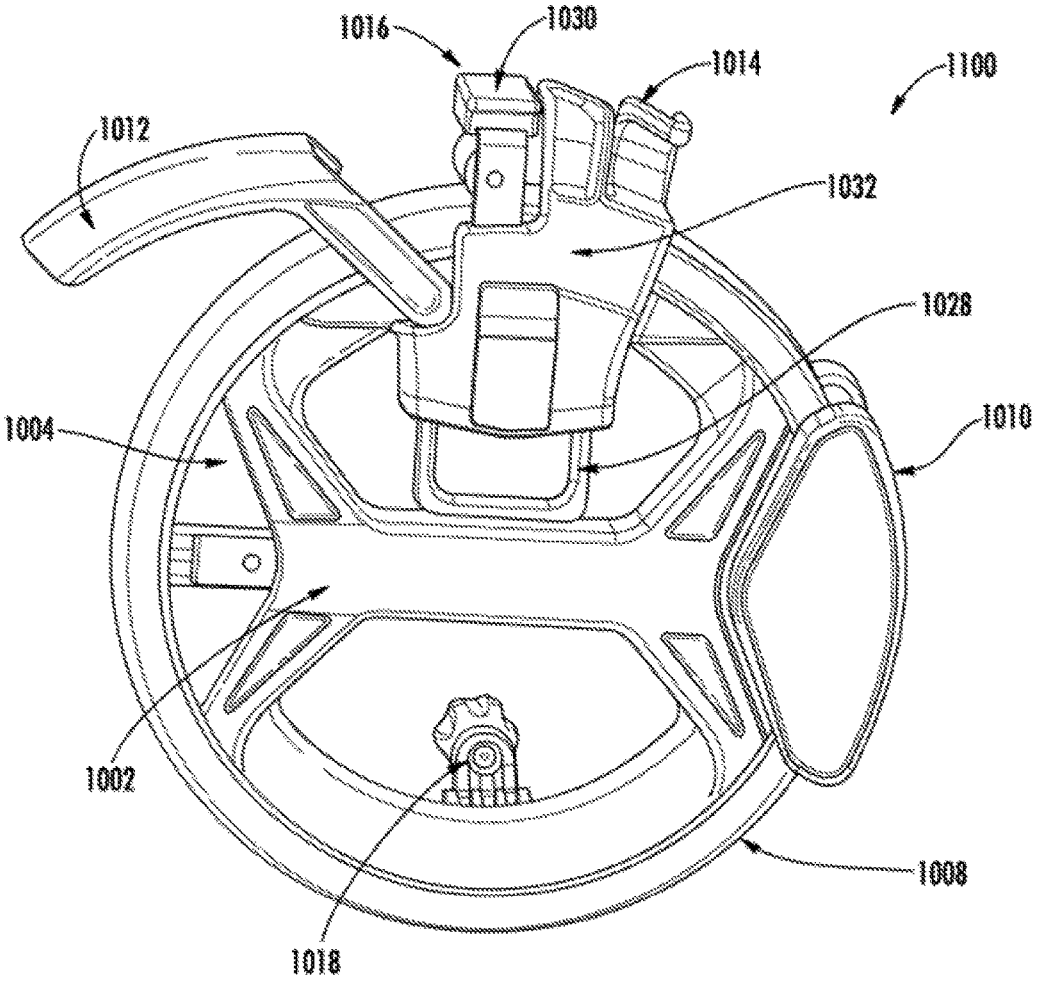
FIG. 2 illustrates a side view of a hubless rope dispensing device, in accordance with one embodiments of the invention.

The material feeding device 1016 may be adjacent to the outer portion 1024 of the wheel 1008 and further comprise an engagement handle 1028, a pinch device 1030, and a material feeding device body 1032 (as seen in FIG. 2). In some embodiments, the material feeding device and/or its components may be operatively coupled to the edge of the mounting frame 1002 so as to extend over and/or around the periphery of the wheel 1008 without coming in contact with the wheel 1008. The pinch device 1030 may be situated proximate to the guide 1014 on and/or around the periphery of the wheel 1008. In some embodiments, the pinch device 1030 has a width that is approximately the same as the width as the wheel 1008. In some embodiments, the wheel 1008 and the pinch device 1030 may receive elongated material input into a first side of the material feeding device 1016 and output the elongated material to a second side of the material feeding device 1016.

In some embodiments, the engagement handle 1028 may extend downward from the material feeding device body 1032. The engagement handle 1028 may be operatively coupled to the pinch device 1030 within the material feeding device body 1032. In some embodiments, the engagement handle 1028 and/or the pinch device 1030 may be pulled or pushed (or otherwise have some force applied) by the user toward the center of the wheel 1008. In this way, a distance between the pinch device 1030 and the wheel 1008 may be decreased to better contact, engage, receive, and/or apply friction to elongated material fed into the material feeding device 1016. In some embodiments, the pinch device 1030, the engagement handle 1028, and/or the material feeding device body 1032 may be operatively coupled to a spring within in the material feeding device body 1032 wherein the spring applies a resistive force to at least somewhat prevent the pinch device 1030 from contacting the wheel 1008 by maintaining a predetermined distance between the pinch device 1030 and the wheel 1008. In some embodiments, a user may apply a force (e.g., a push or pull) to the engagement handle 1028 and/or the pinch device 1030 to overcome the resistive force of the spring to decrease the distance between the pinch device 1030 and the wheel 1008 to better contact, engage, receive, and/or apply friction to elongated material fed into the material feeding device 1016. In some embodiments, the user may apply pressure to the top of the pinch device 1030 (e.g., with the thumb of the user) to better contact, engage, receive, and/or apply friction to elongated material fed into the material feeding device 1016.

In some embodiments, a user operating the rope dispensing device 1000 may at least partially stabilize and support the rope dispensing device 1000 by holding the mounting frame 1002 and/or the engagement handle 1028 during operation.

FIG. 2 illustrates a side view of a hubless rope dispensing device, in accordance with one embodiment of the invention 1100 and further illustrates the components of the rope dispensing device 1000. As illustrated in FIG. 2, in some embodiments, the first side 1004 of the mounting frame 1002 may be a circular body. In some embodiments the diameter of the mounting frame 1002 may be equal to the diameter of the inner portion 1026 of the wheel 1008. In other embodiments, the diameter of at least a portion of the mounting frame 1002 may be greater than the diameter of the inner portion 1026 of the wheel 1008. In still other embodiments, the diameter of the at least a portion of the mounting frame 1002 may be greater than or equal to the diameter of the outer portion 1024 of the wheel 1008. In some embodiments, the first side 1004 of the mounting frame 1002 may not be operatively coupled to the wheel 1008.

In some embodiments the rope dispensing device 1000 of FIGS. 1-2, may be the rope dispensing device 100 of FIGS. 3-8. Furthermore, it should be understood that in some embodiments of the invention, the mounting frame 1002, the first side 1004 of the mounting frame 1002, the second side 1006 of the mounting frame 1002, the wheel 1008, the stabilizing device 1010, the adjustable shroud 1012, the guide 1014, the material feeding device 1016, the pinch device 1030 and the handle 1018 of the rope dispensing device 1000 as described in FIGS. 1-2 ,respectively, may be the mounting frame 102, the first side 104 of the mounting frame 102, the second side 106 of the mounting frame 102, the wheel 108, the stabilizing device 110, the adjustable shroud 206, the guide 302, the material feeding device 314, the pinch device 316, and the handle 502 of the rope dispensing device 100 as described in FIGS. 3-8.

Figure 3:
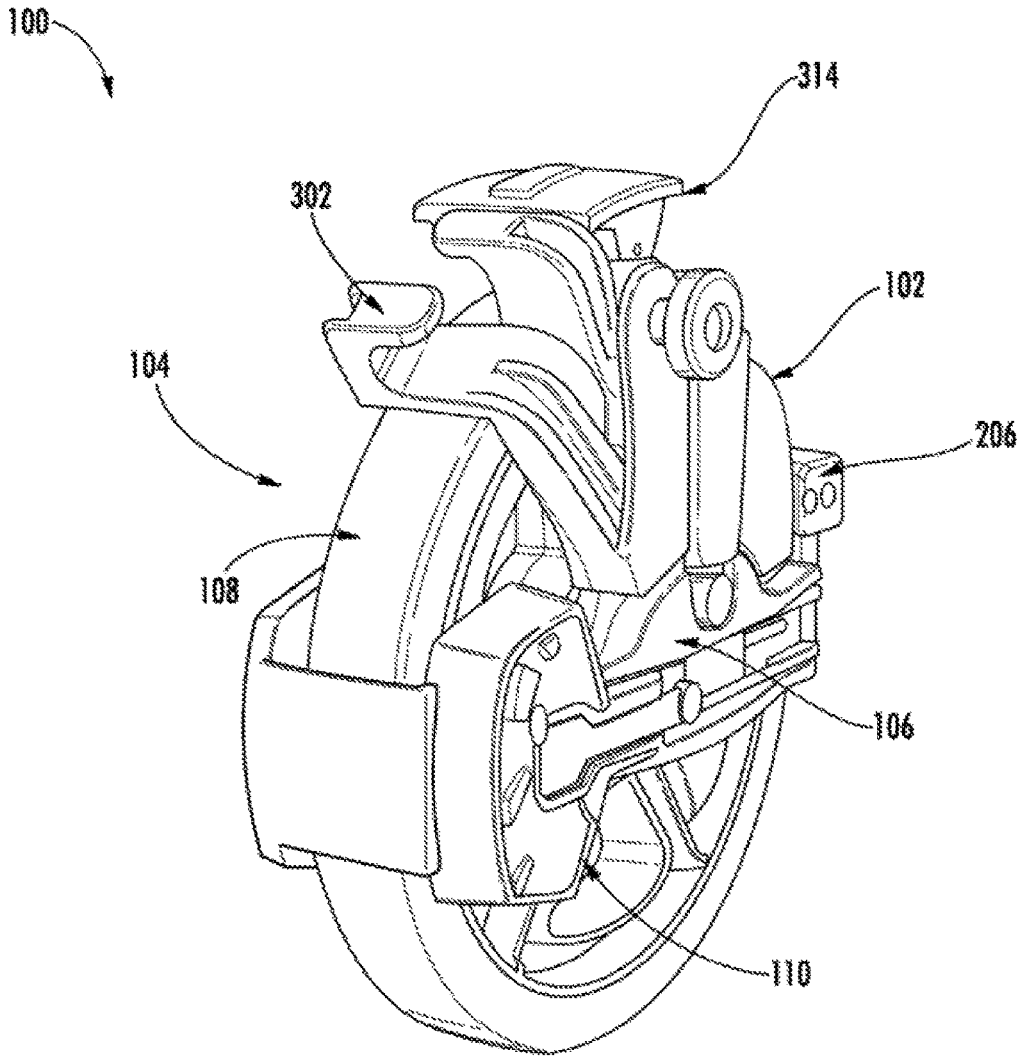
FIG. 3 illustrates a perspective view of a rope dispensing device, in accordance with one embodiment of the invention.

FIG. 3 illustrates a perspective view of a rope dispensing device 100 according to some embodiments of the invention. As illustrated in the FIG. 3, a mounting frame 102 comprises a first side 104 (visible in FIG. 4A) and a second side 106. The mounting frame 102 may be composed of metal, plastic, and/or a composite material. In some embodiments, the mounting frame 102 may have one or more structurally designed holes or gaps in the material comprising the mounting frame 102 which may allow the mounting frame 102 to be lightweight while still providing sufficient structure and support to the rope dispensing device 100. The mounting frame 102 has mounting portions for affixing components to the mounting frame 102. The mounting frame 102 is generally shaped so as to have a diameter that is greater than or equal to the diameter of the wheel 108. In this way, any components operatively coupled to the mounting frame 102 may be allowed to extend around the periphery of the wheel 108. In some embodiments, the mounting frame 102 has a diameter that is less than or equal to the diameter of the wheel 108. In this way, components may be required to extend from the mounting frame 102 and around the wheel 108 if desired. Components operatively coupled to the mounting frame 102 may include a stabilizing device 110, an adjustable shroud 206, a wheel 108, a guide 302, a material feeding device 314, and/or other components.

Figure 4A:
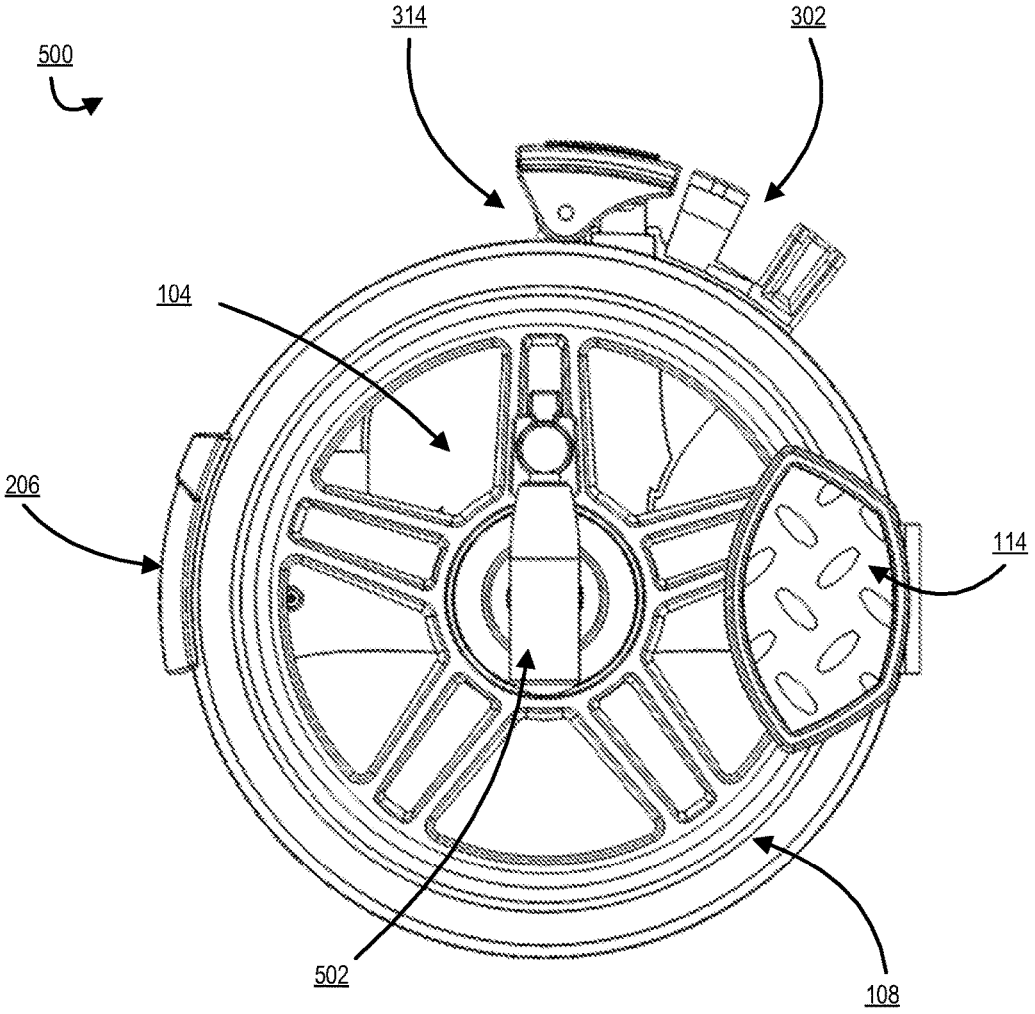
FIG. 4A illustrates a side view of the first side of the mounting frame, in accordance with one embodiment of the invention.

FIG. 4A illustrates a side view of the first side 104 of the mounting frame 102 in one embodiment of the invention 500. The first side 104 of the mounting frame 102 is generally open allowing for the inclusion of the wheel 108 onto the first side 104. In some embodiments, the first side 104 is generally open so as to allow for elongated material to be input into the dispensing device mid-length without the need to begin a material collection process with a terminal end of the elongated material.

In other embodiments of the invention the first side 104 of the mounting frame 102 is not generally open. In other embodiments, the second side 106 of the mounting frame 102 may be generally open while the first side 104 is closed. In some embodiments, the first side 104 and the second side 106 of the mounting frame 102 are both closed wherein the elongated material cannot be loaded mid-length. In some embodiments, the first side 104 and the second side 106 are identical. In some embodiments the mounting frame 102 extends down and wraps around the bottom of the periphery of the wheel 108 to then extend back up the other side of the wheel 108 and operatively couple to an axle 312 (the axle 312 being illustrated in FIG. 6), wherein the upper portion of the frame 102 and wheel 108 remains generally open to allow for loading of the elongated material mid-length into the material feeding device 314.

Figure 6:
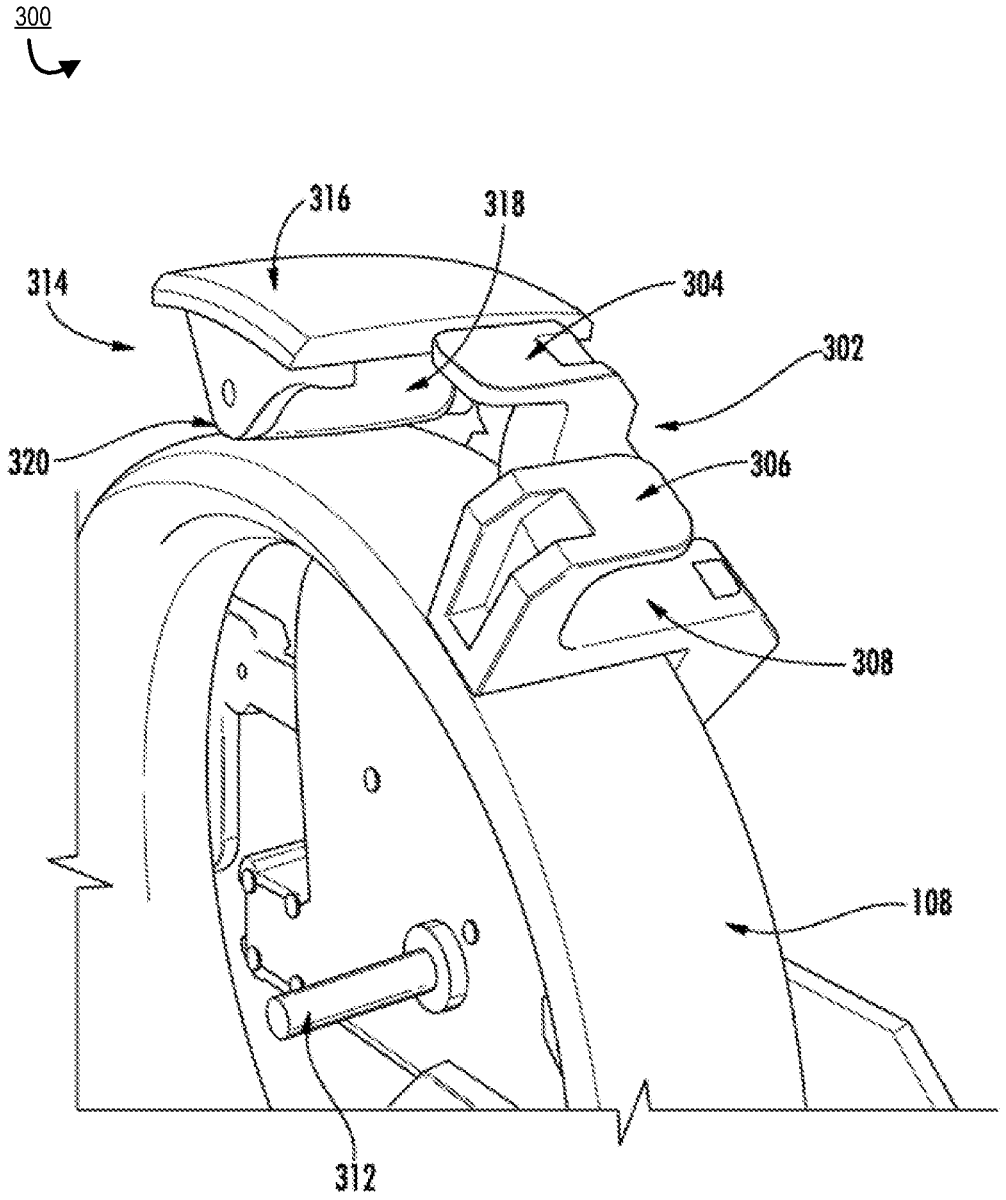
FIG. 6 illustrates a perspective view of a portion of the rope dispensing device including the guide and the material feeding device, in accordance with one embodiment of the invention.

As illustrated in FIG. 4A, the wheel 108 may be located on the first side 104 of the mounting frame 102 and is rotatable about the mounting frame 102. In some embodiments, the wheel 108 may rotate in either a clockwise direction or counter-clockwise direction. In some embodiments, the wheel 108 may be operatively coupled to an axle 312 (as seen in FIG. 6), ball bearing, or similar device which, in turn, is operatively coupled to the first side 104 of the mounting frame 102 allowing the wheel to spin about the axle 312 or similar device. In some embodiments, the wheel 108 may be composed of metal, plastic, and/or a composite material.

In some embodiments of the invention, the wheel 108 is approximately 12 inches in diameter. In other embodiments, the wheel 108 is greater than 12 inches in diameter. In yet other embodiments, the wheel 108 is less than 12 inches in diameter.

In some embodiments, the wheel 108 has a tire to increase frictional force and provide a better grip on the elongated material passing through the device. In some embodiments, the tire is composed of rubber, urethane, plastic, polymer, or the like. In some embodiments, the wheel 108 does not have a tire and is instead composed of a single material. In some embodiments, the wheel 108 may have small protrusions on the outer, periphery surface of the wheel 108 composed of the same material as the wheel 108 to provide grip on the elongated material passing through the device. In other embodiments, the small protrusions on the outer, periphery surface of the wheel 108 may be composed of a different material than that of the wheel 108.

The wheel 108 drives the elongated material through the material feeding device 314. As seen in FIG. 4A and throughout the figures, in some embodiments of the invention, a handle 502 may be operatively coupled to an outer face of the wheel 108 and be operated by the user to manually drive the wheel 108. During operation of the rope dispensing device 100, the user holds handle 502 and moves the handle 502 in a circular motion about the center of the wheel 108 in the direction of desired elongated material output. This motion drives the wheel 108 and, consequently, the elongated material through the rope dispensing device 100.

In some embodiments, the handle 502 may be composed of metal, plastic, and/or a composite material. In other embodiments, the handle 502 may be a knob or a protrusion extending from the outer face of the wheel 108 that may be used to manually drive the wheel 108. In other embodiments of the invention, the wheel 108 may be driven by a motor. In some embodiments, a motor used to drive the wheel 108 may be integrated or attached to the rope dispensing device 100, while in other embodiments, the motor may be separate from the device.

In some embodiments, the handle 502 may be operatively coupled to a face of the wheel 108 to allow for the handle 502 to collapse and fold into the outer face of the wheel 108 when not in use to allow for a more compact form while the rope dispensing device is being stored and/or transported as illustrated in FIG. 4A. In other embodiments, the handle 502 may be operatively coupled to an outer face of the wheel 108 in a fixed orientation without the ability to be collapsed or folded. In some embodiments, the handle 502 may be operatively coupled or rotationally coupled to the outer face of the wheel 108 to enable the handle 502 to spin on the outer face of the wheel 108 allowing the wheel 108 to be rotated by the user gripping the handle 502 without requiring the user to re-grip the handle 502 as the wheel 108 rotates and to avoid the handle 502 from spinning within the grip of the user during operation of the rope dispensing device 100.

As illustrated in FIG. 4A, a second plate 114 of the stabilizing device 110 extends around the periphery of the wheel 108 on the first side 104 of the mounting frame 102. The stabilizing device 110 and its components are discussed later in detail with respect to FIG. 5. The material feeding device 314 and the guide 302 extending from the second side 106 of the mounting frame 102 around the periphery of the wheel 108 are also illustrated in FIG. 4A and throughout the figures. Both the material feeding device 314 and the guide 302 are discussed in detail later with respect to FIG. 6. Additionally, a portion of the adjustable shroud 206 extending from the second side 106 of the mounting frame 102 around the periphery of the wheel 108 is illustrated in FIG. 4A and is discussed in detail with respect to FIG. 4B.

Figure 4B:
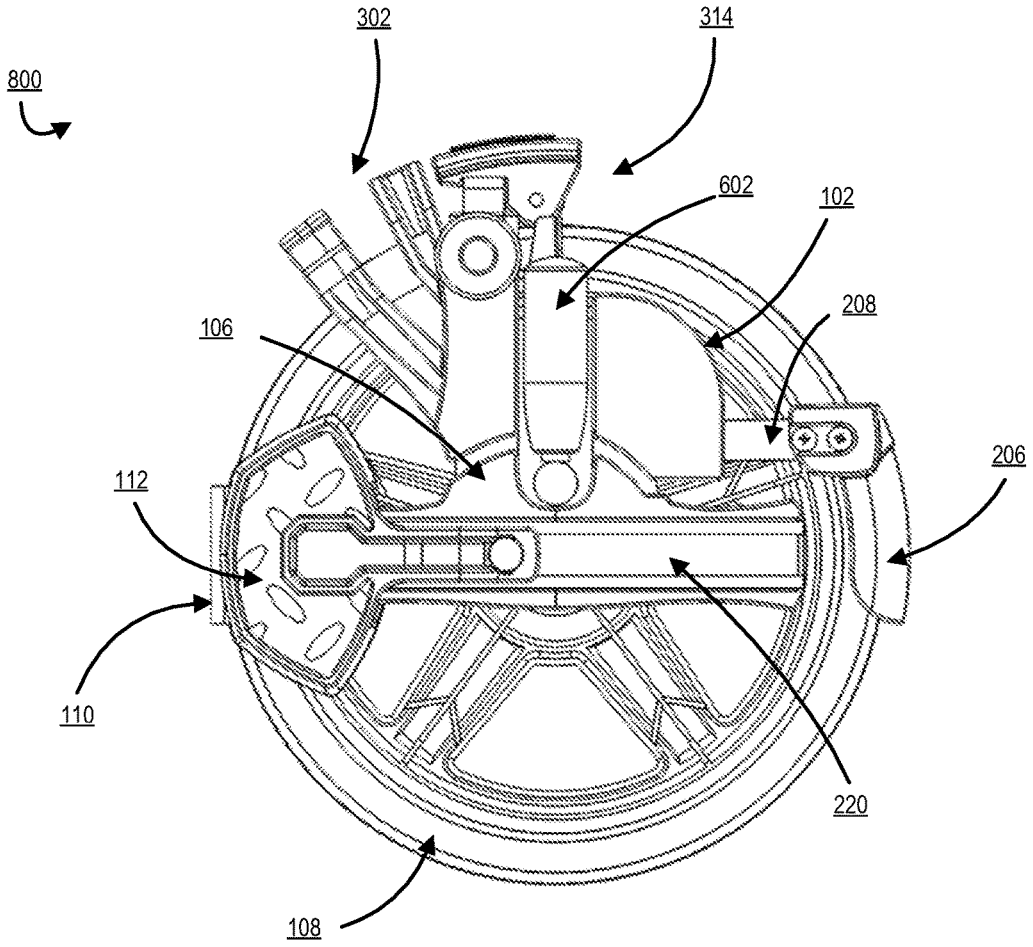
FIG. 4B illustrates a side view of the second side of the mounting frame, in accordance with one embodiment of the invention.

FIG. 4B illustrates a side view of the second side 106 of the mounting frame 102 according to one embodiment of the invention 800. In some embodiments, the second side 106 of the mounting frame 102 may be generally closed. The second side 106 may further comprise mounting portions for affixing components to the mounting frame 102 allowing for components to be operatively coupled to the mounting frame 102 and easily accessed by a user operating the device. Components operatively coupled to the mounting frame 102 via the mounting portions may include the stabilizing device 110, the adjustable shroud 206, the guide 302, the material feeding device 314 and/or other devices or components described herein.

As illustrated in FIG. 4B, the adjustable shroud 206 is operatively coupled to an extension arm 208 which, in turn, is operatively coupled to the mounting frame 102 so that the adjustable shroud 206 may be positioned adjacent to at least a portion of the periphery or outer portion of the wheel 108. Both the adjustable shroud 206 and the extension arm 208 may be composed of metal, plastic, and/or a composite material. The adjustable shroud 206 directs the output of the elongated material from the material feeding device 314 by enclosing a portion of the outer edge of the wheel 108. In this way, the adjustable shroud 206 may control a change in direction of the elongated material based on the position of the adjustable shroud in relationship to the wheel 108 and/or the material feeding device 314. The adjustable shroud 206 does not generally come into contact with the wheel 108 during operation of the rope dispensing device and allows the wheel 108 to rotate freely while only contacting the elongated material to direct and control the output. The shape of the adjustable shroud 206 is generally that of a hollow half-cylinder that is arced to approximately conform to the curvature of the wheel 108 allowing for the capture and direction of the output elongated material. In some embodiments, the adjustable shroud 206 may be shaped and formed similar to a fender around a portion of a wheel 108. The width of the adjustable shroud 206 may be greater than the width of the wheel 108 so as to allow the adjustable shroud 206 to encompass a portion of the periphery of the wheel 108 while in a non-operable, compact state according to some embodiments of the invention.

In some embodiments, the operative coupling of the extension arm 208 and the mounting frame 102 allows for the adjustable shroud 206 to be repositioned about the periphery of the wheel 108, as later illustrated in FIG. 8*b*, allowing for the output of the elongated material to be directed in a forward and/or downward direction. In some embodiments, the extension arm 208 is a flat bar that is approximately parallel to the wheel 108 and does not come into contact with the wheel 108. The extension arm 208 is at least long enough to allow the adjustable shroud 206 to extend around the periphery of the wheel 108. In some embodiments of the invention, the extension arm 208 may be operatively coupled to the mounting frame 102 in a way as to allow the extension arm 208 and adjustable shroud 206 to extend out and away from the mounting frame 102, past the periphery of the wheel 108 to allow for a variable gauge of elongated material to fit between the adjustable shroud 206 and the wheel 108. In some embodiments, the adjustable shroud 206 may be extendably and/or detachably coupled to the first side 104 and/or second side 106 of the mounting frame 102.

As illustrated in FIG. 4B, a first plate 112 of the stabilizing device 110 may be operatively coupled to a sliding component 220 which, in turn, may be operatively coupled to the second side 106 of the mounting frame 102. The stabilizing device 110 and its components are discussed later in detail with respect to FIG. 5.

The material feeding device 314 and the guide 302 extending from the second side 106 of the mounting frame 102 around the periphery of the wheel 108 are also illustrated in FIG. 4B, both of which are discussed in detail with respect to FIG. 4.

As illustrated in FIG. 4B and throughout the figures, in some embodiments of the invention, a handheld stabilizing device 602 may be operatively coupled to the second side 106 of the mounting frame 102 and be held by the user to at least partially support the rope dispensing device. In some embodiments, the handheld stabilizing device 602 may be composed of metal, plastic, and/or a composite material. In other embodiments, the handheld stabilizing device 602 is simply a knob or generally a protrusion extending from second side 106 of the mounting frame that may be used to at least partially support the rope dispensing device 100 by the user. In some embodiments, the handheld stabilizing device 602 may be integrated into the mounting frame 102 (e.g., as a handle or other integrated, graspable portion). In other embodiments, the rope dispensing device 100 may not comprise the handheld stabilizing device, wherein the user may hold a portion of the mounting frame 102 and/or other operatively coupled components described herein to at least partially stabilize the device during operation.

In some embodiments, the handheld stabilizing device 602 may be operatively coupled to the second side 106 of the mounting frame 102 in a way as to allow for the handheld stabilizing device 602 to collapse and fold into the second side 106 of the mounting frame 102 when not in use to allow for a more compact form while the rope dispensing device 100 is being stored and/or transported as illustrated in FIG. 4B. In other embodiments, the handheld stabilizing device 602 may be operatively coupled to the second side 106 of the mounting frame 102 in a fixed orientation without the ability to be collapsed or folded for a more compact form. In other embodiments, the invention does not comprise the handheld stabilizing device 602. In some embodiments, a user operating the rope dispensing device may at least partially stabilize and support the rope dispensing device by holding at least a portion of the mounting frame 102 and/or one or more portions of the attached components during operation of the rope dispensing device.

Figure 5:
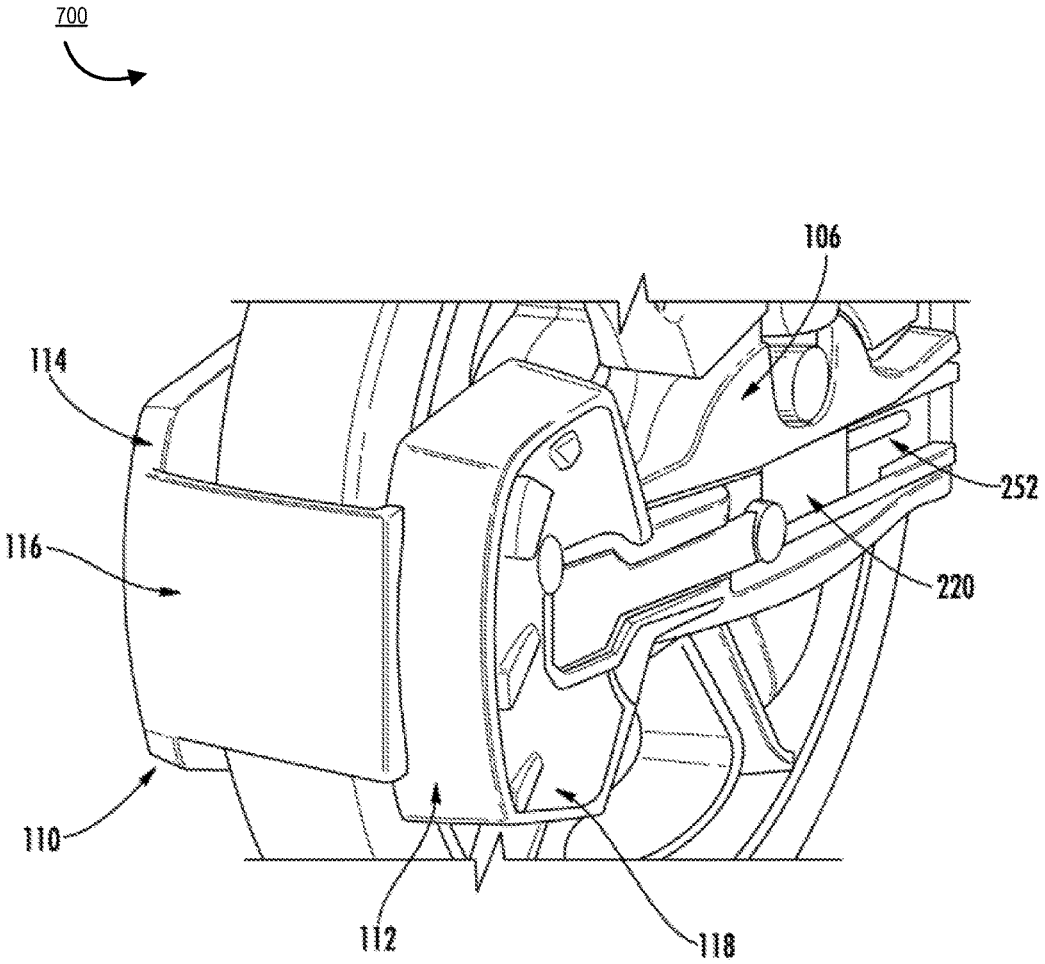
FIG. 5 illustrates a perspective view of the stabilizing device, in accordance with one embodiment of the invention.

FIG. 5 illustrates a perspective view of the stabilizing device 110 according to one embodiment of the invention 700. The stabilizing device 110 may be used to at least partially support the rope dispensing device with the body of a user operating the rope dispensing device. In some embodiments, the stabilizing device 110 comprises a first plate 112 operatively coupled to the sliding component 220 which, in turn, is operatively coupled to the second side 106 of the mounting frame 102. In other embodiments, the first plate 112 and/or the sliding component 220 may be operatively coupled to the first side 104 of the mounting frame 102. The first plate 112 is also operatively coupled to connection plate 116 which spans around at least a portion of an outer portion or periphery of the wheel 108 to operatively couple to a second plate 114. In some embodiments, the stabilizing device 110 spans at least a portion of a side of the wheel 108 outside the width of the wheel 108. In some embodiments, the stabilizing device 110 spans at least a portion of an aperture created by the wheel 108. In some embodiments of the invention, the stabilizing device 110 and its components may be composed of metal, plastic, and/or a composite material.

In some embodiments, the stabilizing device 110 may be operatively coupled to the second side 106 of the mounting frame 102. In some embodiments, the stabilizing device 110 comprises a sliding component 220 which may be operatively coupled to the second side 106 of the mounting frame 102 via a slot 252 allowing the sliding component 220 to slide and extend the stabilizing device 110 away from the periphery wheel 108. Extending the stabilizing device 110 allows the user access to the stabilizing device 110 to at least partially stabilize and support the rope dispensing device during operation. Alternatively, the sliding component 220 operatively coupled to the second side 106 via the slot 252 may allow the stabilizing device 110 to slide the stabilizing device 110 in closer to the wheel 108, collapse into the mounting frame 102, and thus create a more compact form for storage and/or transport. In some embodiments, the sliding component 220 travels along the second side 106 of the mounting frame 102 via a ball bearing or a similar connection. In some embodiments (e.g., the embodiments of FIG. 1 and FIG. 2), the sliding component 220 may be an elongated beam or rod that is positioned parallel to one of the first side 104 and/or second side 106 of the rope dispensing device 100. The elongated beam or rod may be contained by a casing or sheath operatively coupled to the mounting frame 102 wherein the elongated beam may travel through the casing or sheath to allow the stabilizing device 110 to extend out away from the wheel 108 for operation of the rope dispensing device 100, or alternatively, slide closer in towards the wheel 108 for storage and/or transport. The stabilizing device 110 may further comprise a selection pin which may be positioned through one or more holes in the mounting frame and/or casing as well as through one or more regularly spaced holes of the elongated beam in order to operatively couple the stabilizing device 110 to the mounting frame 102 at a selected position or relative distance away from the wheel 108 and mounting frame 102.

As illustrated in FIG. 5, the first plate 112 of the stabilizing device 110 may be operatively coupled to the sliding component 220. The connection plate 116 may be operatively coupled to the first plate 112 and extend from the first plate 112 around the periphery of the wheel 108 to operatively couple to the second plate 114. The second plate 114 may be positioned on the first side 104 of the mounting frame 102 and be operatively coupled to the connection plate 116 so as to not interfere with the rotation of the wheel 108 on the first side 104 of the mounting frame 102. In other embodiments, the second plate 114 of the stabilizing device 110 may be operatively coupled to at least one other point of the rope dispensing device in addition to or in place of the operative coupling to the connection plate 116.

The first plate 112 and the second plate 114 are generally parallel to the face of the wheel 108 but do not come into contact with the wheel 108 during use of the rope dispensing device. In some embodiments, the exterior faces of the first plate 112 and the second plate 114 are approximately flat. In other embodiments, the exterior faces of the first plate 112 and the second plate 114 are shaped so as to conform the body of the user (e.g., the knees or legs of the user).

In some embodiments, the first plate 112 and the second plate 114 further comprise one or more members that interact with a user operating the rope dispensing device 100, wherein the one or more members come into contact with a portion of the user to at least partially support and stabilize the rope dispensing device during operation. In some embodiments, the one or more members comprise padding 118 on the outer faces of the plates which come in contact with the body of the user during operation of the rope dispensing device. The padding 118 allows for increased comfort and for the user operating the rope dispensing device while the user is at least partially supporting the invention with the stabilizing device 110. In some embodiments, the composition and/or texture of the padding 118 allows for increased friction between the stabilizing device 110 and the user so that the rope dispensing device 110 is secured in place during operation and does not substantially move as a whole relative to the user. In some embodiments of the invention, the rope dispensing device is at least partially supported by the user operatively coupling the stabilizing device 110 to the body of the user. In some embodiments, the padding 118 may be shaped so as to conform the body of the user (e.g., the knees or legs of the user). In some embodiments, the rope dispensing device is at least partially supported by the user operatively coupling the stabilizing device 110 between the legs of the user and more specifically, the knees of the user.

In some embodiments, the stabilizing device 110 is extendable, collapsible, and/or removably detachable from the mounting frame 102. In some embodiments, the stabilizing device 110 may be attached in an alternate position (e.g., rotated 180° around the wheel 108) on the mounting frame 102 that still allows for operation of the rope dispensing device 100 with the use of the stabilizing device 110. In some embodiments, attaching the stabilizing device 110 to the alternate position on the mounting frame 102 allows for the elongated material to be delivered behind the user.

While in an operable configuration extended away from the wheel, the stabilizing device 110, specifically the first plate 112, the second plate 114, and the connection plate 116, form an initial guide in which the elongated material may initially travel before entering the guide 302 during a material collection process. In some embodiments, the initial guide formed by the stabilizing device 110 may assist in initially directing the elongated material into the rope dispensing device 100. In other embodiments of the invention, the elongated material does not initially travel through the initial guide formed by the stabilizing device 110.

In some embodiments (e.g., the invention as embodied in FIG. 1 and FIG. 2), the stabilizing device 110 and/or any other components of the rope dispensing device 100 may be operatively couple to at least one of the first side 104 and/or the second side 106 of the rope dispensing device 100.

FIG. 6 illustrates a perspective view of a portion of the rope dispensing device including the guide 302 and the material feeding device 314 according to one embodiment of the invention 300. It should be noted that some components of the rope dispensing device, for example portions of the wheel 108, have been removed from the illustration in order to better exhibit other components on display in FIG. 6. Both the guide 302 and the material feeding device 314 may be composed of metal, plastic, and/or a composite material.

In some embodiments, the guide 302 may be operatively coupled to the second side 106 of the mounting frame 102 adjacent to the pinch device 316 and extend over the periphery of the wheel 108 without coming in contact with the wheel 108. The guide 302 may be adjacent to the pinch device 316 wherein the pinch device 316 and the wheel 108 may receive elongated material from the guide 302. Alternatively, the guide 302 may be adjacent and/or forward of the pinch device 316, wherein the guide 302 may receive the elongated material from the pinch device 316. The guide 302 comprises a first hooked protrusion 304 and a second hooked protrusion 306 which rise up from the top of the guide 302, out and away from the periphery of the wheel 108. In some embodiments, the first hooked protrusion 304 and the second hooked protrusion 306 are C-shaped. The first hooked protrusion 304 and the second hooked protrusion 306 are staggered on opposite ends of the guide 302 with the openings of the hooks facing inwards towards each other so as to create a structured pathway 308 in the direction of the rotation of the wheel 108 in which the elongated material may be directed to travel. The elongated material may be pulled through the guide 302 and directed into the material feeding device 314.

In some embodiments of the invention, the elongated material may alternatively be input into the guide 302 and the material feeding device 314 mid-length by placing the elongated material mid-length into the structured pathway 308 via the top of the guide 302. The elongated material may be manipulated or threaded around the first hooked protrusion 304 and the second hooked protrusion 306 and loaded laterally into the material feeding device 314 without the need to begin a material collection process with a terminal end of the elongated material.

In some embodiments of the invention, the structured pathway 308 may instead be formed by a spring-shaped spiral structure operatively coupled to the top of the guide 302 instead of the hooked protrusions. The spiral structure may encircle the elongated material and acts as a tube to direct the elongated material as it travels into the material feeding device 314.

FIG. 6 further illustrates the material feeding device 314 which is used to secure and drive the elongated material through the rope dispensing device. In some embodiments, the material feeding device 314 may comprises the wheel 108 and/or a pinch device 316. The pinch device 316 is operatively coupled to the edge of the mounting frame 102 so as to extend over the periphery of the wheel 108 without coming in contact with the wheel 108. The pinch device 316 may be situated proximate to the guide 302 on the periphery of the wheel 108. The wheel 108 and the pinch device 316 may receive the elongated material input on a first side 318 of the material feeding device 314 (i.e., from the guide) and output the elongated material on a second side 320 of the material feeding device 314 (i.e., to the adjustable shroud). In some embodiments, the pinch device 316 has a width that is approximately the same as the width as the wheel 108.

In some embodiments of the invention, the pinch device 316 may be spring-loaded and in contact with the wheel 108 allowing for various gauges of elongated material to be input through the material feeding device 314. The pinch device 316 allows the elongated material entering the material feeding device 314 to pass between the pinch device 316 and the wheel 108 while force from an engaged spring operatively coupled to the pinch device 316 may secure the elongated material within the material feeding device 314. In other embodiments of the invention, the pinch device 316 is not spring-loaded and is a fixed distance away from the wheel 108. In some embodiments, the pinch device 316 may be a pinch wheel. In some embodiments, the pinch wheel may be spring-loaded.

The width or gauge of the elongated material that may be processed and delivered by the rope dispensing device 100 depends at least partially on the width of the wheel 108 and the size of the structured pathway 308 created by the guide 302 as well as the magnitude of extension of both the adjustable shroud 206 and the pinch device 316 away from the wheel 108.

As illustrated in FIG. 6, in some embodiments, the wheel 108 may be operatively coupled to an axle 312, ball bearing, or similar device which, in turn, may be operatively coupled to the first side 104 of the mounting frame 102 allowing the wheel to spin about the axle 312 or similar device in either a clockwise direction or counter-clockwise direction.

Figure 7:
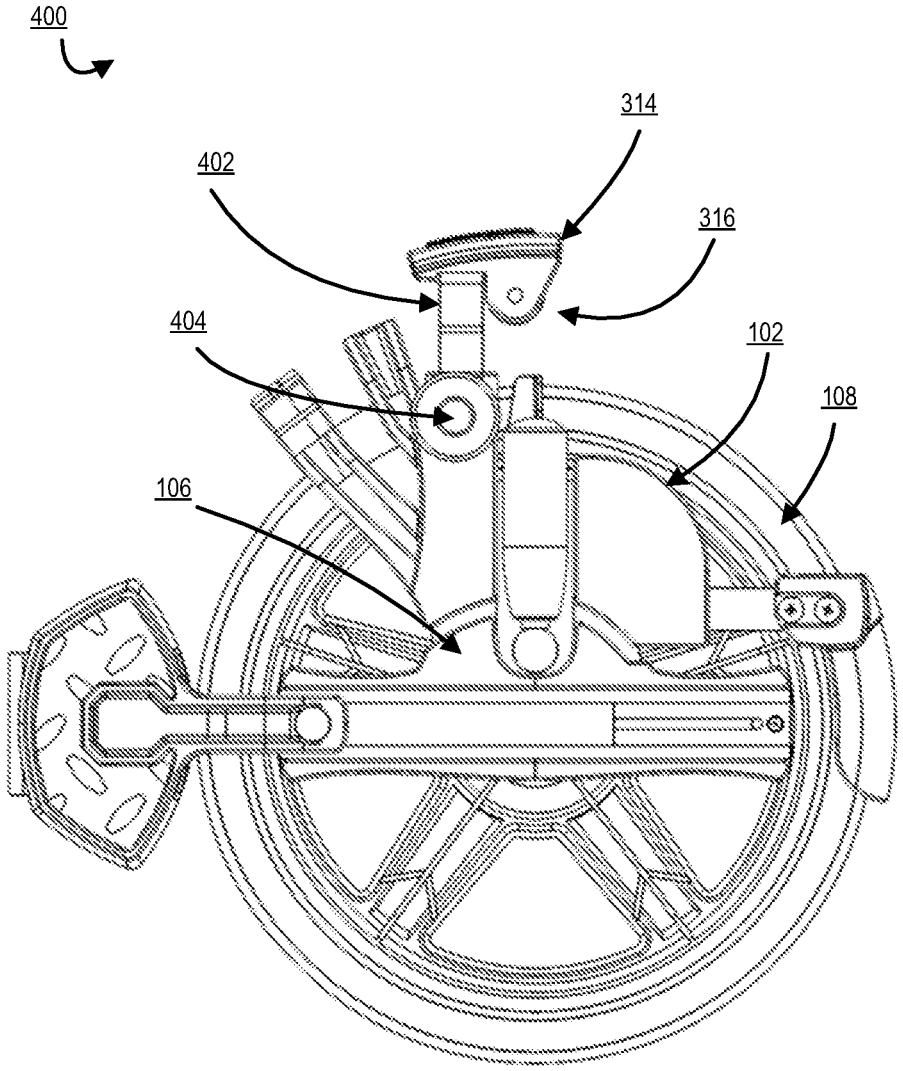
FIG. 7 illustrates a side view of the second side of the mounting frame of the rope dispensing device, in accordance with one embodiment of the invention.

FIG. 7 illustrates a side view of the second side 106 of the mounting frame 102 of the rope dispensing device 100 according to one embodiment of the invention 400. As previously discussed in relation to FIG. 6, the material feeding device 314 may be operatively coupled to the second side 106 of the mounting frame 102. In some embodiments of the invention, the pinch device 316 comprises a neck extension 402 which is operatively coupled to the mounting frame 102 or a material feeding device body. The neck extension 402 may be able to be extended out and away from the mounting frame 102 altering the distance between the pinch device 316 and the wheel 108. The adjustable distance of the pinch device 316 from the wheel 108 allows for a variable gauge of elongated material to be input into the material feeding device 314 and delivered by the rope dispensing device. Similar to the other components of the material feeding device 314, the neck extension 402 may be composed of metal, plastic, and/or a composite material. In some embodiments, the neck extension 402 may be a bar having a rectangular cross section, the bar having a length less than or equal to the radius of the wheel 108. In other embodiments, the cross sectional shape of the bar may be square, circular, or another shape. In still other embodiments, the neck extension 402 may be a substantially flat bar.

In some embodiments, the extended length setting of the neck extension 402 may be locked in place on the mounting frame 102 by a knob 404 which may be operatively coupled to the second side 106 of the mounting frame 102. The knob 404 may be composed of similar materials to the neck extension 402. In some embodiments, the knob 404 may be generally circular but may be of any size or shape as to fit in the hand of the user while not disrupting the functions of any other components of the rope dispensing device 100.

In some embodiments of the invention, the knob 404 may lock the neck extension 402 in place by, for example, passing a pin on the knob 404 through one of several evenly spaced holes along the length of the neck extension 402. In some embodiments, the knob 404 may be operatively coupled to a spring which may be operatively coupled to the second side 106 of the mounting frame 102, wherein the engaged spring keeps the knob 404 locked into the neck extension 402 at a particular position requiring the user to pull the knob 404 to temporarily unlock the neck extension 402 and the knob 404 in order to reposition the neck extension 402 and alter the distance of the pinch device 316 from the wheel 108.

In some embodiments, the neck extension 402 may collapse into the mounting frame 102 allowing the pinch device 316 to come into contact with the wheel 108 creating a compact form for transportation and/or storage. In some embodiments, the neck extension 402, and therefore the pinch device 316, may be detached from the mounting frame 102.

Figure 8A:
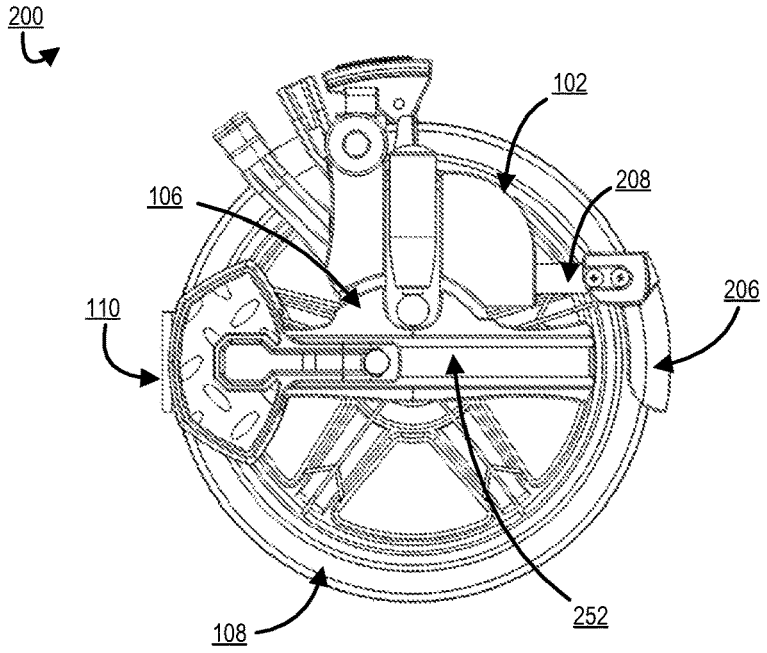
FIG. 8A illustrates a side view of the second side of the mounting frame of the rope dispensing device in a collapsed state, in accordance with one embodiment of the invention.

FIG. 8*a* illustrates a side view of the second side 106 of the mounting frame 102 of the rope dispensing device 100 in a collapsed state according to one embodiment of the invention 200. Components of the rope dispensing device, as illustrated in FIG. 8*a*, are able to collapse into the mounting frame 102 to create a more compact form for storage and/or transport of the rope dispensing device.

As illustrated in FIG. 8*a*, the stabilizing device 110 is completely collapsed into the mounting frame 102. As previously discussed with respect to FIG. 5, the sliding component 220 of the stabilizing device 110 has traveled along the slot 252 (visible in FIG. 8*b*) to allow the stabilizing device 110 to fully collapse into the mounting frame 102, wherein the connection plate 116 between the first plate 112 and the second plate 114 is in contact with or close to making contact with the wheel 108. Alternatively, in some embodiments, the stabilizing device 110 may be detached from the mounting frame 102 for more convenient storage and/or transport.

As illustrated in FIG. 8*a*, the adjustable shroud 206 operatively coupled to the extension arm 208 may collapse into the mounting frame 102, wherein the adjustable shroud 206 is in contact with or in close proximity to the wheel 108 and encompasses a portion of the wheel 108 while in the collapsed state. Alternatively, in some embodiments, the adjustable shroud 206 and extension arm 208 may be detached from the mounting frame 102 for more convenient storage and/or transport.

Figure 8B:
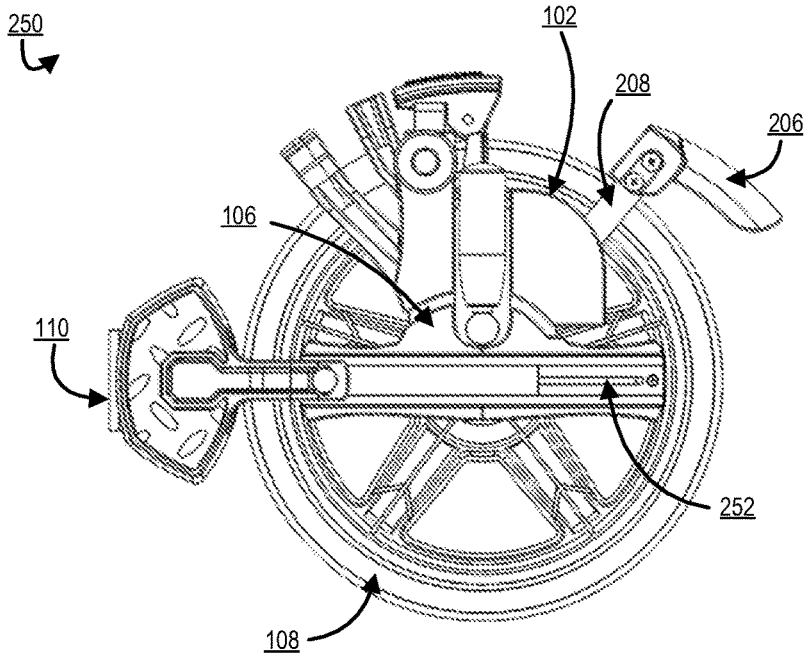
FIG. 8B illustrates a side view of the second side of the mounting frame of the rope dispensing device in an extended, operable state, in accordance with one embodiment of the invention.

FIG. 8*b* illustrates a side view of the second side 106 of the mounting frame 102 of the rope dispensing device in an extended, operable state according to one embodiment of the invention 250. While in the extended state, the rope dispensing device is designed to be operated by the user.

As illustrated in FIG. 8*b*, and as previously discussed with respect to FIG. 5, the sliding component 220 may travel along the slot 252 allowing for the stabilizing device 110 to extend out from the mounting frame 102 to allow rope dispensing device 110 to be at least partially stabilized by the stabilizing device 110 operatively coupled to the body of the user.

Also illustrated in FIG. 8*b*, and as previously discussed with respect to FIG. 4B, the adjustable shroud 206 may extend out from the mounting frame 102 allowing for the throughput of elongated material with variable gauge. The operative coupling of the adjustable shroud 206 to the arm extension 208 which, in turn, is operatively coupled to the mounting frame 102, enables the adjustable shroud 206 to be repositioned about the periphery of the wheel 108 allowing for the output of the elongated material to be directed in a forward and/or downward direction.

Figure 9A:
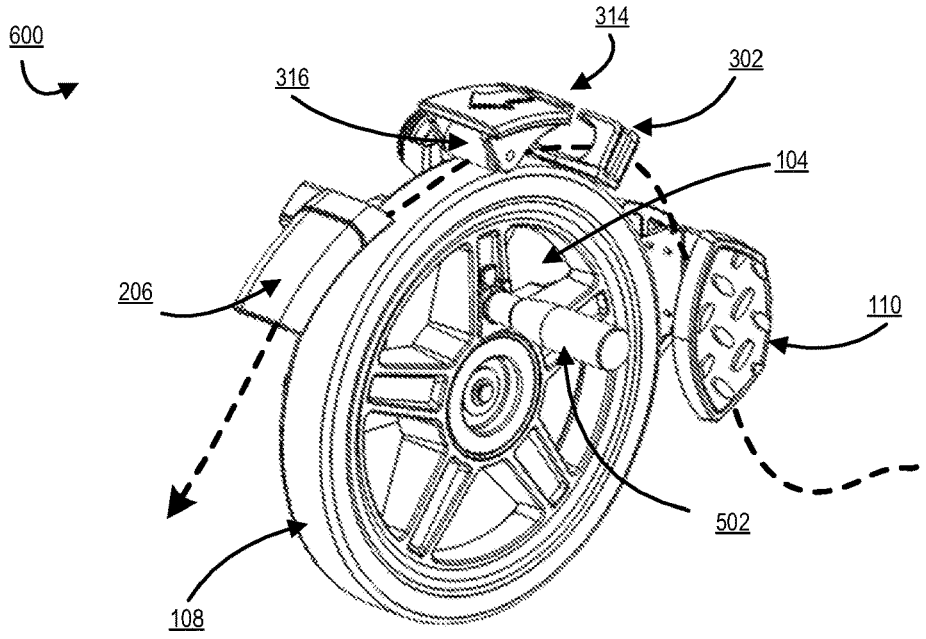
FIG. 9A illustrates a perspective view of the rope dispensing device in an operable configuration with the first side in the foreground , in accordance with one embodiment of the invention.

FIG. 9A illustrates a perspective view of the rope dispensing device in an operable configuration with the first side 104 in the foreground according to one embodiment of the invention 600. As illustrated in FIG. 9A, the stabilizing device 110 is fully extended allowing the user to partially support the rope dispensing device by operatively coupling the stabilizing device 110 to the body of the user. Additionally, the adjustable shroud 206 is extended away from the wheel 108 so as to allow the elongated material to pass through and be directed out of the rope dispensing device. While only one configuration of the rope dispensing device 100 is illustrated in FIG. 9A, in other embodiments, the adjustable shroud 206 could alternatively be repositioned about the periphery of the wheel 108 so as to direct the output elongated material in a more downward direction.

Also illustrated in FIG. 9A, the handle 502 is extended out from the outer face of the wheel 108 in an operable position. As previously discussed with respect to FIG. 4A, while in this operable position, the handle 502 may be used to partially support the rope dispensing device 100 while driving the wheel 108. While at least partially supporting the rope dispensing device 100 with the handle 502, the user moves the handle 502 in a circular motion about the center of the wheel 108 in the direction of desired elongated material output. This motion drives the wheel 108 and consequently the elongated material through the rope dispensing device 100.

Figure 9B:
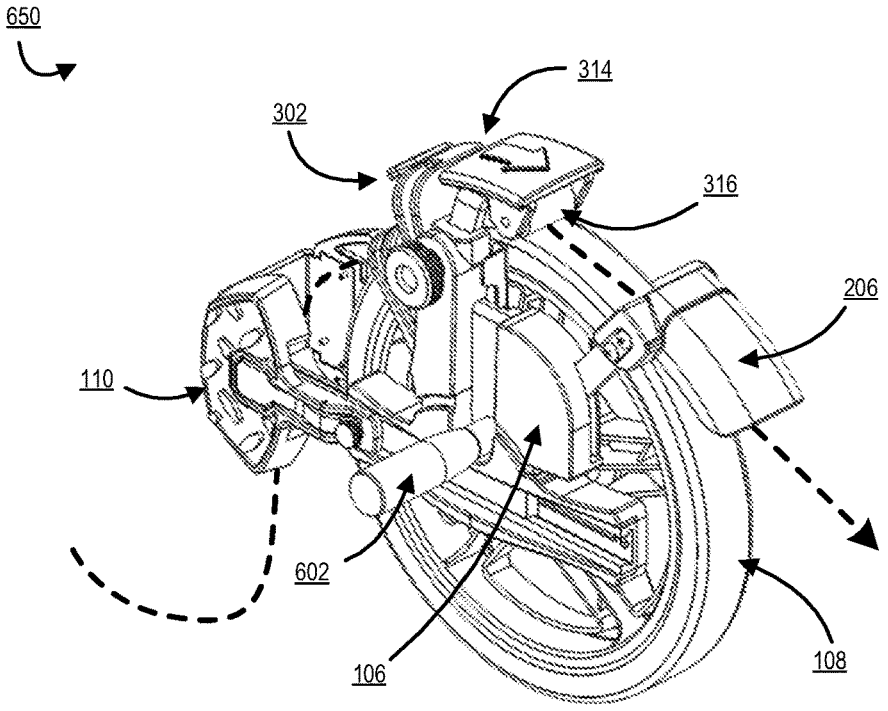
FIG. 9B illustrates a perspective view of the rope dispensing device in an operable configuration with the second side in the foreground, in accordance with one embodiment of the invention.

FIG. 9B illustrates a perspective view of the rope dispensing device in an operable configuration with the second side 106 in the foreground according to one embodiment of the invention 650. As illustrated in FIG. 9B, and as previously discussed with respect to FIG. 9A, the stabilizing device 110 is fully extended, while both the pinch device 316 and the adjustable shroud 206 are extended away from the wheel 108 so as to allow the elongated material to pass through and be directed out of the rope dispensing device 100.

Additionally, as illustrated in FIG. 9B and as previously discussed with respect to FIG. 4B, the handheld stabilizing device 602 is extended out from the second side 106 of the mounting from 102 in an operable position allowing the user to at least partially support the rope dispensing device during operation.

As illustrated by FIG. 9A and 9B, a path of the elongated material as it is driven through the rope dispensing device 100 is represented by the dashed line in both figures. After being first fed into the rope dispensing device either at a terminal end or mid-length, the elongated material driven through the rope dispensing device 100 first passes through the stabilizing device 110 which creates an initial guide to roughly funnel the elongated material in a path towards the guide 302. The elongated material next enters the guide 302 wherein its direction is refined and targeted towards the material feeding device 314. While passing through the material feeding device 314, the elongated material is driven through the rope dispensing device by the rotation of the wheel 108 grabbing and uptaking the elongated material with assistance from the pinch device 316. The elongated material exits the material feeding device 314 and is guided and directed by the adjustable shroud 206 towards the user-desired destination such as a bag, tarp, or other container. In some embodiments, the elongated material may be output from the rope dispensing device 100 in an ordered or structured form such as a pile, spool, or the like, wherein the elongated material may be easily collected by the user in an organized format.

It should be understood that elongated material may also be driven through the rope dispensing device 100 a direction opposite to the pathway as described and defined in FIGS. 9A and 9B., wherein the elongated material may be input into the rope dispensing device 100 at the adjustable shroud before being driven through the pinch device 316 and then the guide 302 respectively. It should also be understood that the direction of the driven elongated material may be changed or reversed during operation of the rope dispensing device 100, wherein the wheel 108 may be stopped and turned in the reverse direction to change the input and output directions of the elongated material relative to the rope dispensing device 100.

In some embodiments of the invention, the rope dispensing device 100 may be handheld, wherein the rope dispensing device 100 is supported and stabilized by the user. In other embodiments, the rope dispensing device may be mounted in a stand, bracket, and/or the like wherein the rope dispensing device is at least partially supported and stabilized by the stand, bracket, and/or the like. In some embodiments, the rope dispensing device 100 may be mounted to a surface (e.g., a wall) during operation of the device. In some embodiments, a bag, basket, container, or other form of receptacle may be mounted or operatively coupled to the rope dispensing device 100 to receive and/or provide a source of elongated material from and/or to the rope dispensing device 100. In some embodiments, the rope dispensing device 100 may employ a combination of one or more of the previously described support and stabilization systems during operation.

Figure 10:
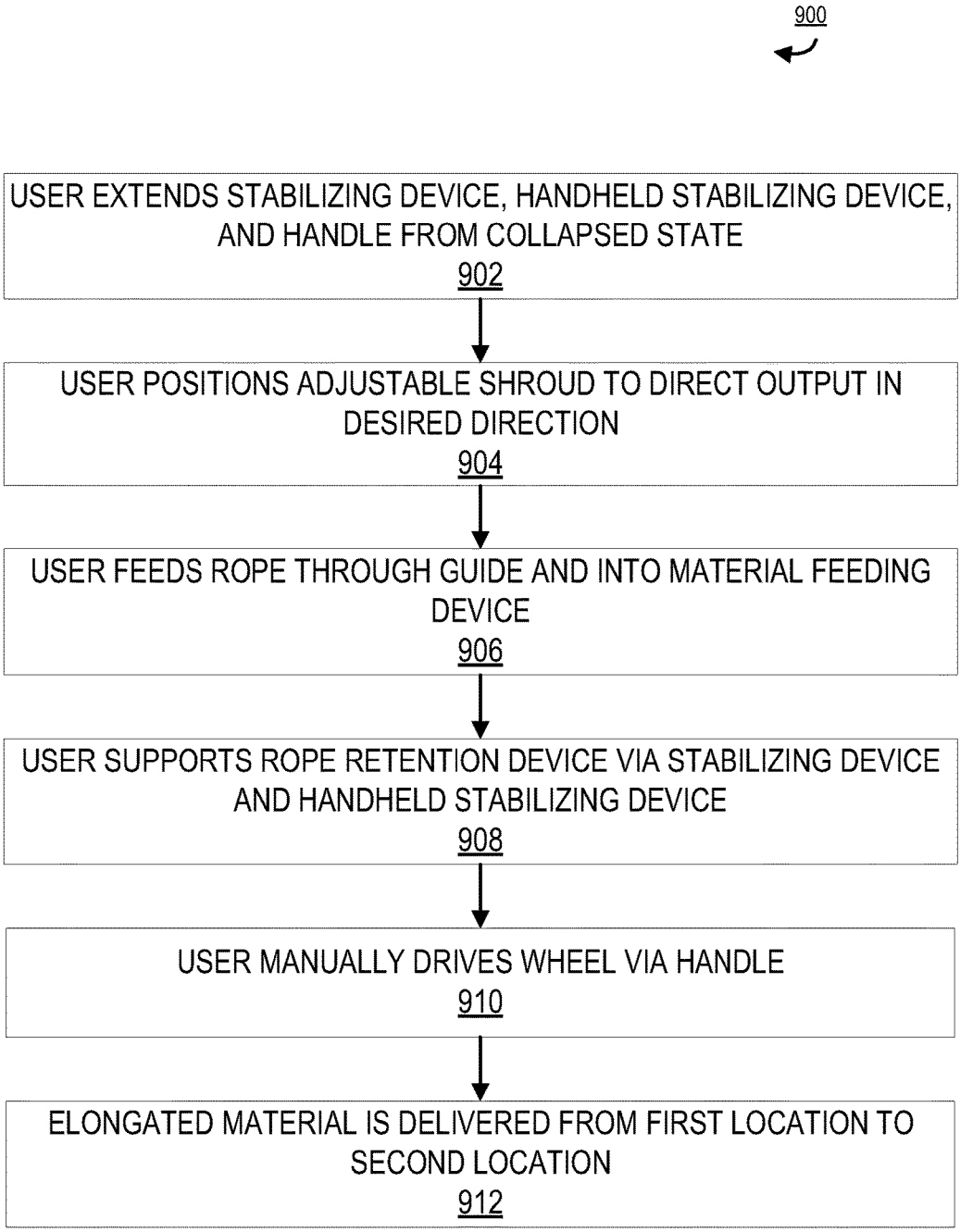
FIG. 10 provides a process flow illustrating the operation of the rope dispensing device from the perspective of a user, in accordance with one embodiment of the invention.

FIG. 10 provides a process flow illustrating the operation of the rope dispensing device from the perspective of a user 900, according to one embodiment of the invention. As illustrated in block 902 of FIG. 10, beginning with a fully collapsed rope dispensing device, the user extends the stabilizing device, the handheld stabilizing device, and the handle from the collapsed states to the operable positions. Next, as illustrated in block 904, the user positions the adjustable shroud to a position about the periphery of the wheel in order to direct the output elongated material in a user-desired direction.

Next, as illustrated in block 906 of FIG. 10, the user places the elongated material in the structured pathway created by the guide and feeds the elongate material into the juncture of the wheel and the pinch device of the material feeding device. In some embodiments, the user may place the end of the elongated material in the pathway. In yet other embodiments, the user may place a middle portion of the elongated material in the pathway. As illustrated in block 908, the user secures and supports the rope dispensing device 100 by operatively coupling the stabilizing device between his or her legs while simultaneously holding the hand-held stabilizing device with one hand. The user begins to manually drive the rope dispensing device by engaging the handle on the outer face of the wheel with his/her other hand, moving the handle in a circular motion about the center of the wheel, and driving the wheel in the user-desired direction of rope output by as illustrated in block 910 of FIG. 10. The input rope is directed by the guide into the first side of the material feeding device where it is driven by the wheel to pass between the pinch device and the wheel and output on the second side of the material feeding device. Finally, as illustrated by bock 912 of FIG. 10, the user continues to drive the wheel delivers the elongated material from an initial position, through the rope dispensing device, and to a second location such as a bag, tarp, or other container.

It should be understood that the terms "first side" and "second side" may be used to differentiate and identify portions of the mounting frame herein. In some embodiments of the invention, the first side and the second side may be interchangeable, wherein the first side may function as the second side or, similarly, the second side may function as the first side. In this way, in some embodiments of the invention, the rope dispensing device and the location of any attached components may be mirrored while still being able to perform the same or similar functions as the non-mirrored device. For example, the guide may be attached to either the first side or the second side of the mounting frame while still being able to perform the same function.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. A device for delivering elongated material, comprising:

a mounting frame comprising a first side and a second side;

a wheel rotationally coupled to the mounting frame, the wheel comprising an outer portion and an inner portion concentric with the outer portion;

a material feeding device operatively coupled to the mounting frame;

an adjustable shroud operatively coupled to the mounting frame; and a stabilizing device operatively coupled to the mounting frame, wherein the material feeding device receives the elongated material at a first location and outputs the elongated material at a second location, wherein the adjustable shroud is configured for directing the elongated material to the second location, wherein the stabilizing device is configured to contact a body of a user to support the device, and wherein the wheel creates an aperture within a diameter of the inner portion.

2. The device of claim 1, wherein the first side of the mounting frame further comprises:

the material feeding device adjacent to an outer portion of the wheel;

the adjustable shroud extendably and detachably coupled to the first side of the mounting frame; and the stabilizing device spanning a portion of the aperture, wherein the second side of the mounting frame is rotationally coupled to the wheel.

3. The device of claim 1, wherein the wheel is circular and further comprises:

a first side rotationally coupled to the mounting frame;

a second side comprising a handle; and a tire operatively coupled to the outer portion of the wheel, wherein the inner portion is parallel to the outer portion, and wherein the diameter of the inner portion is less than the diameter of the outer portion.

4. The device of claim 3, wherein the first side of the wheel is rotationally coupled to the second side of the mounting frame with one or more bearings.

5. The device of claim 1, wherein the adjustable shroud positioned adjacent to at least a portion of the outer portion of the wheel and controls a change in direction of the elongated material based on a position of the adjustable shroud in relationship to the outer portion of the wheel and the material feeding device.

6. The device of claim 1, wherein the stabilizing device forms around at least a portion of the outer portion of the wheel and comprises a first plate and a second plate, wherein the stabilizing device is extendable, collapsible, and detachable from the mounting frame, and wherein the first plate and the second plate of the stabilizing device comprise one or more members that interact with the user.

7. The device of claim 1, wherein the material feeding device further comprises:

a pinch device operatively coupled to an engagement handle; and a guide positioned adjacent to the pinch device, wherein the engagement handle is operatively coupled to a first spring;

wherein a force applied to the engagement handle decreases a distance between the pinch device and the wheel; and wherein the pinch device and the wheel receive the elongated material input from the guide within the distance between the pinch device and the wheel and output the elongated material to the adjustable shroud.

8. The device of claim 7, wherein the pinch device further comprises a pinch wheel operatively coupled to a second spring and in contact with the wheel to accept various sizes of elongated material between the wheel and the pinch device.

9. The device of claim 1, wherein the elongated material comprises rope, wire, or hosing and wherein when the elongated material fed through the device generally forms a spool of elongated material.

10. The device of claim 1, wherein the wheel is driven manually by the user.

11. A device for delivering elongated material, comprising:

a mounting frame comprising a first side and a second side;

a material feeding device operatively coupled to the mounting frame;

an adjustable shroud operatively coupled to the mounting frame;

a stabilizing device operatively coupled to the mounting frame; and a wheel comprising a first side rotationally coupled to the mounting frame, a second side, and an outer portion operatively coupled to an inner portion, the inner portion concentric with the outer portion, wherein the diameter of the inner portion is less than the diameter of the outer portion, wherein the wheel creates an aperture within the diameter of the inner portion, wherein the material feeding device receives the elongated material at a first location and outputs the elongated material at a second location, wherein the adjustable shroud is configured for directing the elongated material to the second location, and wherein the stabilizing device is configured to contact a body of a user to support the device.

12. The device of claim 11, wherein the first side of the mounting frame further comprises:

the material feeding device adjacent to the outer portion of the wheel;

the adjustable shroud extendably and detachably coupled to the first side of the mounting frame; and the stabilizing device spanning a portion of the aperture, and wherein the second side of the mounting frame is rotationally coupled to the wheel.

13. The device of claim 11, wherein the first side of the wheel is rotationally coupled to the second side of the mounting frame with one or more bearings.

14. The device of claim 11, wherein the adjustable shroud positioned adjacent to at least a portion of the outer portion of the wheel and controls a change in direction of the elongated material based on a position of the adjustable shroud in relationship to the outer portion of the wheel and the material feeding device.

15. The device of claim 11, wherein the stabilizing device forms around at least a portion of the outer portion of the wheel and comprises a first plate and a second plate, wherein the stabilizing device is extendable, collapsible, and detachable from the mounting frame, and wherein the first plate and the second plate of the stabilizing device comprise one or more members that interact with the user.

16. The device of claim 11, wherein the material feeding device further comprises:

a pinch device operatively coupled to an engagement handle; and a guide positioned adjacent to the pinch device, wherein the engagement handle is operatively coupled to a first spring;

wherein a force applied to the engagement handle decreases a distance between the pinch device and the wheel; and wherein the pinch device and the wheel receive the elongated material input from the guide within the distance between the pinch device and the wheel and output the elongated material to the adjustable shroud.

17. The device of claim 16, wherein the pinch device further comprises a pinch wheel operatively coupled to a second spring and in contact with the wheel to accept various sizes of elongated material between the wheel and the pinch device.

18. A device for delivering elongated material, comprising:

a mounting frame comprising a first side, a second side, and an axle;

a wheel rotationally coupled to the axle, the wheel comprising an outer portion and an inner portion concentric to the outer portion and forming a concentric aperture within a diameter of the wheel;

a material feeding device operatively coupled to the mounting frame;

an adjustable shroud operatively coupled to the mounting frame; and a stabilizing device operatively coupled to the mounting frame, wherein the material feeding device receives the elongated material at a first location and outputs the elongated material at a second location, wherein the adjustable shroud is configured for directing the elongated material to the second location, and wherein the stabilizing device is configured to contact a body of a user to support the device.

19. The device of claim 18, wherein the first side of the mounting frame further comprises:

the material feeding device adjacent to an outer portion of the wheel;

the adjustable shroud extendably and detachably coupled to the first side of the mounting frame; and the stabilizing device spanning a portion of the wheel outside of the width of the wheel, and wherein the first side of the mounting frame is rotationally coupled to the wheel by the axle.

20. The device of claim 18, wherein the aperture remains at least partially empty during operation of the device.

* * * * *